350-166 SR
1/26/88 XR 4,721,217

United States Patent [19]
Phillips et al.

[11] Patent Number: 4,721,217
[45] Date of Patent: Jan. 26, 1988

[54] TAMPER EVIDENT OPTICALLY VARIABLE DEVICE AND ARTICLE UTILIZING THE SAME

[75] Inventors: Roger W. Phillips; Vernon C. Spellman; Wayne L. Gossett; Marc A. Kamerling, all of Santa Rosa, Calif.

[73] Assignee: Optical Coating Laboratory, Inc., Santa Rosa, Calif.

[21] Appl. No.: 894,320

[22] Filed: Aug. 7, 1986

[51] Int. Cl.[4] ..... B65D 55/02
[52] U.S. Cl. ..... 215/230; 206/459; 206/807; 229/102; 350/166
[58] Field of Search ..... 215/230, 365, 366; 229/102; 206/807, 459; 383/5; 350/166

[56] References Cited

U.S. PATENT DOCUMENTS

| | | | |
|---|---|---|---|
| 3,858,977 | 1/1975 | Baird et al. | 350/166 X |
| 4,475,661 | 10/1984 | Griffin | 215/230 X |
| 4,480,749 | 11/1984 | Lavcis et al. | 206/807 X |
| 4,502,605 | 3/1985 | Wloszczyna | 215/230 |

*Primary Examiner*—Donald F. Norton
*Attorney, Agent, or Firm*—Flehr, Hohbach, Test, Albritton & Herbert

[57] ABSTRACT

Tamper evident optically variable device comprising an optically variable device having at least first and second layers with a spacer layer therebetween providing a color shift with change in viewing angle. A release layer is disposed between the first and second layers to permit the first and second layers to be separated from each other and to thereby destroy the optical shifting properties of the optically variable device.

21 Claims, 10 Drawing Figures

TAMPER EVIDENT OPTICALLY VARIABLE DEVICE AND ARTICLE UTILIZING THE SAME

This invention relates to a tamper evident optically variable device and to an article utilizing the same.

Because tampering with certain consumer-type products, there has been an attempt to make such products more tamper proof, or in other words, tamper resistant. Even though many changes have been made to make consumer type products more tamper resistant, the tamper resistant packaging provided still can be violated. In view of the fact that making packaging more tamper proof is expensive and often makes the consumer type products more difficult to utilize by the consumer, there is a need for a different approach to attempt to solve the problems. Thus for example, rather than attempting to make the consumer type products more tamper resistant, an alternative approach which may be preferable is to make the package in such a way so that if tampering occurs it will be evident to the consumer at the point of sale. There is therefore a need for a device which can be utilized on articles such as packages and containers which will make it apparent to the consumer at the point of sale if tampering has occurred.

In general, it is an object of the invention to provide a device which can be utilized with packaging to indicate to the consumer when tampering has occurred.

Another object of the invention is to provide a device of the above character which is an optically variable device.

Another object of the invention is to provide a device of the above character which can be utilized in conjunction with containers.

Another object of the invention is to provide a device of the above character which can be rapidly incorporated in packaging utilizing conventional packaging equipment.

Another object of the invention is to provide a device of the above character in which there is a color shift with angle change.

Another object of the invention is to provide a device of the above character in which the angle shift properties are destroyed when the integrity of the packaging has been violated.

Additional objects and features of the invention will appear from the description in which the preferred embodiments are set forth in detail in conjunction with the accompanying drawings.

In general the tamper evident optically variable device of the present invention is comprised of an optically variable device having at least first and second layers which provide the optically variable device with optical shifting properties with angle. A release layer is disposed between the first and second layers of the optically variable device to permit the first and second layers of the optically variable device to be separated to destroy the optical shifting properties of the optically variable device.

The article which utilizes the tamper evident optically variable device has first and second parts which are movable with respect to each other. The tamper evident optically variable device has its first and second layers secured respectively to the first and second parts of the article so that when the first and second parts of the article move with respect to each other, the release layer permits the movement of the first and second layers with respect to each other to destroy the optical shifting properties of the optically variable device.

Figure 1:
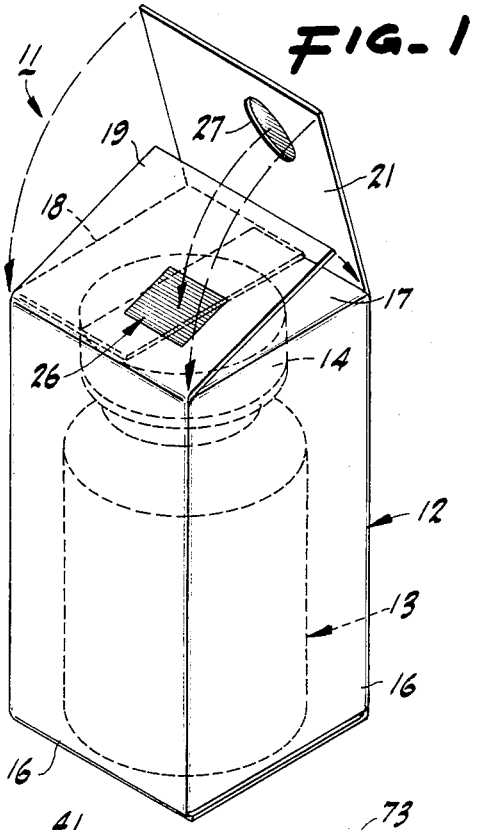
FIG. 1 is a perspective view of a package and container of the present invention incorporating a tamper evident optically variable device.

More particularly as shown in the drawings, the tamper evident optically variable device and the article utilizing the same as shown in FIG. 1 consists of a container package 11. The container package 11 consists of a box 12 which contains therein a bottle 13 having a cap 14 threadedly mounted thereon. The bottle 13 can be formed of any suitable material such as glass or plastic. Similarly, the cap 14 can also be formed of a suitable material such as metal or plastic. As shown the bottle 13 has a conventional cylindrical configuration. The box 12 also is of a conventional cardboard type and is of a generally rectangular configuration. The box is formed in a conventional manner and is provided with flaps for closing the ends. The box is provided with four side walls in which adjoining side walls extend at right angles to each other. Four flaps 17, 18, 19 and 21 are provided on each end of the box 12. Two of the flaps, as for example, 19 and 21 serve as first and second parts of the box and are movable with respect to each other.

Figure 2:
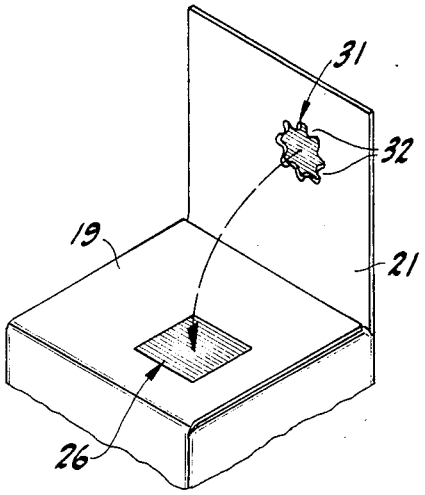
FIG. 2 is a perspective view of a package containing another embodiment of the present invention.

The tamper evident optically variable device 26 of a type hereinafter described is disposed between the flaps 19 and 21. An aperture window 27 is provided in the outer flap 21 to permit viewing of the optically variable device 26 to see whether or not it has angle shifting properties. As can be seen from FIG. 1, the window 27 has a circular configuration. Other configurations can be utilized if desired. For example as shown in FIG. 2, another type of window 31 has been provided which has serrations 32 formed in its margins which serve a purpose as hereinafter described.

Figure 3:
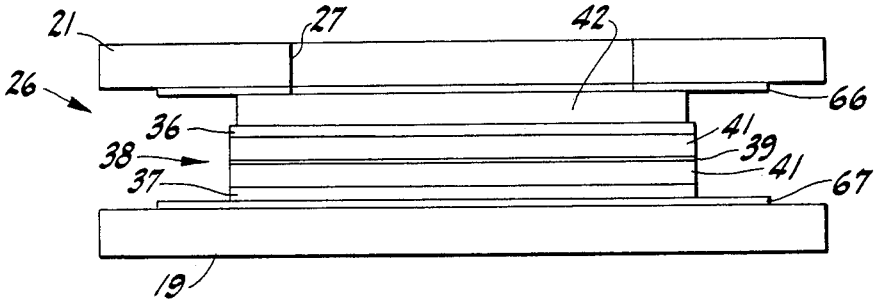
FIG. 3 is a cross-sectional view of a tamper evident optically variable device utilized on a container such as a bottle incorporating the present invention.

The tamper evident optically variable device 26 of the present invention can be of the type shown in FIG. 3. As shown therein, the tamper evident optically variable device 26 can be of the type described in co-pending application Ser. No. 630,414 filed on July 13, 1984. As described therein, it is comprised of at least first and second layers 36 and 37 which form part of a metal-dielectric-metal interference filter 38. A release layer 39 is disposed between first and second layers 36 and 37 and, as shown, is provided in a spacer layer 41. The layers 36, 37, 39 and 41 are formed upon and carried by a substrate 42 to provide the interference filter 38.

Figure 7:
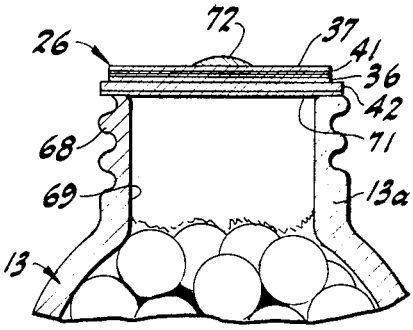
FIG. 7 is a partial cross-sectional view showing the upper portion of a container having an optically variable device mounted thereon.
Figure 5:
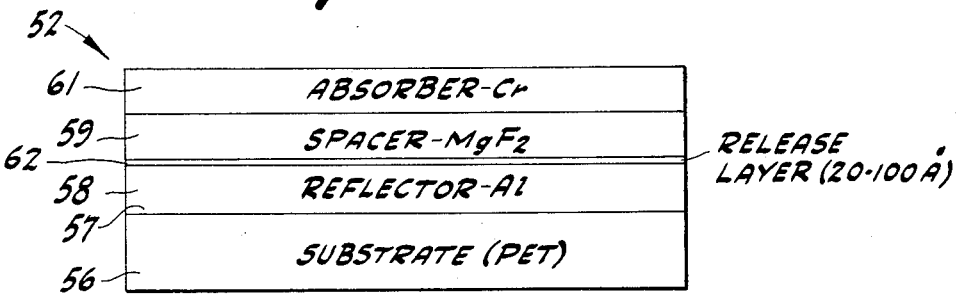
Figure 6:
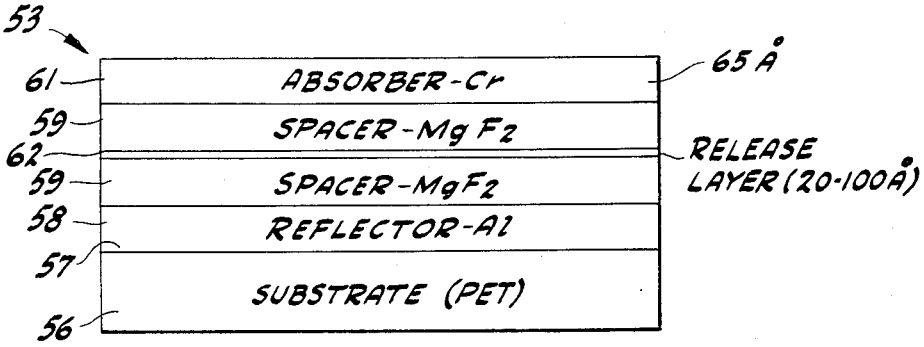

The release layer 39 is disposed between the absorber layer and the reflector layer. Three general designs of the tamper evident optically variable device of the present invention are shown in FIGS. 5, 6 and 7. Each of the designs consists of a substrate 56 which has at least one surface 57. The substrate 56 is formed of a suitable material of the type described in co-pending application Ser. No. 630,414 filed on July 13, 1984. As described therein it can be formed of polyethylene terephthalate (PET). Typically the substrate 56 can be formed of material having a thickness ranging between 75 gauge and 140 gauge which would be approximately 0.0075 inches to 0.005 inches. The substrate material is preferably transparent. However, if desired it can be opaque.

A reflector layer 58 is deposited on the surface 57 of the substrate 56. The reflector layer 58 is formed of a metal and is deposited to a thickness so that it is opaque. The metal utilized should preferably be a high reflector such as aluminum. Other metals can be utilized which have a whitish appearance and which have good reflection characteristics. For example, reflectors such as nickel and silver (if stabilized) could be used. In addition, other materials such as commonly known grey metals can be utilized if their lower reflection characteristics can be tolerated. The metal utilized should be deposited to a thickness so it is opaque. If aluminum is used, this would be a thickness of approximately 600 Angstroms ± 20%.

A dielectric spacer layer 59 is deposited on the metal reflector layer 58. In order to obtain as rapid a color shift as possible, it is desirable that the spacer layer be formed of a material having a very low index of refraction. For that reason, the layer is formed of a dielectric having an index of refraction of n=1.65 or below. Materials meeting this criteria are inorganic materials like magnesium fluoride, n=1.38; yttrium fluoride, n=1.55; silicon dioxide, n=1.45, etc. Organic materials such as TFE (tetrafluoroethylene, Teflon®), n=1.38; FEP (fluorinated ethylene-propylene copolymer) n=1.34; polypropylene, n=1.45; polyethylene, n=1.5; polyethylene terephthate (PET, Mylar®) n=1.6; or waxes, n=(Fix) 1.5 may be utilized. The spacer layer 59 is put down to a thickness ranging from between 3 and 7 quarter waves with a design wavelength in the visible spectrum that ranges from 400 to 700 microns. It has been found that if more than 7 quarter waves are utilized the color becomes muted or becomes white. If approximately less than 3 quarterwaves are utilized, there is insufficient color shift.

A metal absorber layer 61 is deposited on the spacer layer 61. The thickness of the spacer layer 59 determines which wavelengths will be absorbed by the absorber layer 61. Thus it can be seen that by changing a thickness of the spacer layer, different colors can be obtained for the color shift desired with the optically variable device. The absorber layer 61 is formed of a highly absorbing material such as a metal and is put on to a thickness so that it provides substantially zero reflection at the selected design wave length in the visible spectrum. The metal which is utilized in the absorber layer 61 can be any of the grey metals such as chromium, nickel, titanium, vanadium, cobalt and palladium. The use of such grey metals for the absorber layer 61 is desirable because the gray metals have high absorption values. A grey metal can be characterized as a metal having high absorption where the n and k are nearly equal and the ratio of k over n is small as, for example, in the range of 1:2. When the grey metal is placed on the spacer layer to provide a minimum of reflection in the visible spectrum, it has a thickness which is in the vicinity of 100 Angstroms or less. For example, if the absorber layer is formed of chromium, it can have a thickness of approximately 65 Angstroms±10%.

Figure 4:
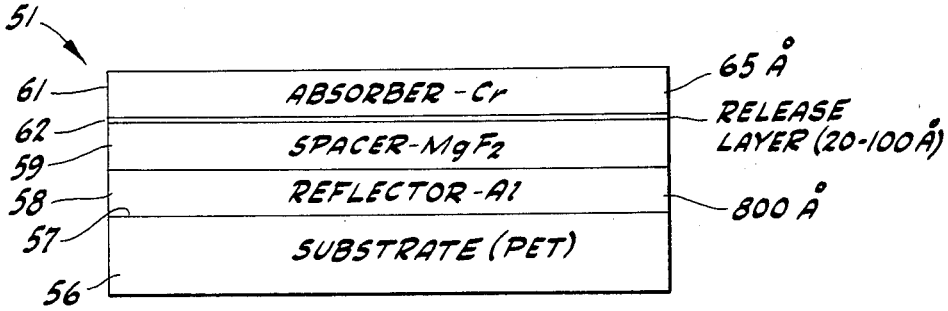
FIGS. 4, 5 and 6 are cross-sectional views of three different designs for tamper evident optically variable devices for use in a package.

In the optically variable devices shown in FIGS. 4, 5 and 6, it can be seen that a metal dielectric metal or tri-layer system design has been provided in which the spacer layer serves the critical function providing the desired color shift. In each of the three designs, a release layer 62 has been incorporated, either in the spacer layer 59 itself or on opposite sides of the spacer layer 59. Thus as shown in FIG. 4, the release layer 62 has been provided between the absorber layer 61 and the spacer layer 59. In the design shown in FIG. 5, the release layer 62 has been provided between the spacer layer 59 and the reflector layer 58. In the third design shown in FIG. 6, the release layer 62 has been provided between the two separate portions of the spacer layer 59.

The release layer 62 is formed of a meterial having an index of refraction which is close as possible to the index of refraction of the spacer layer 59 so that it does not effect to a significant degree the optical properties of the optically variable device. The release layer 62 should be formed of a material which permits separation of the metal-dielectric-metal interference filter which comprises the optically variable device. One material found to be particularly satisfactory for this purpose is Teflon which is flashed onto the appropriate layer in the desired position as shown by any one of the three designs shown in FIGS. 4, 5 and 6 to a suitable thickness as for example, from 20 to 100 Angstroms. By providing such a release layer 62 it is possible to readily separate the absorber layer from the reflector layer and thus destroy the optically variable effects of the optically variable device to render the optically variable device non-functional. By separating the absorber layer from the reflector layer, the phase coherence of the interference filter is destroyed. Once this phase coherence has been destroyed, it is impossible to re-establish this phase coherence even if an attempt is made to reassemble the two separated parts. It has been found that once an optically variable device has been separated in a manner in which the absorber layer is separated from the reflector layer, the color shift characteristics have been destroyed. Even if it would be possible to restore some color shift characteristics, a different color shift or color resembling an oil slick would occur which would clearly disclose that the optically variable device had been tampered with. Attempts to re-establish the optically variable device by gluing together the two parts would result in failure because the glue itself would have some finite thickness which would make it impossible to restore the color shift characteristics so that a single color would still remain or, at best, a different color shift would be achieved.

The designs shown in FIGS. 4–6 can also be used in the reverse configuration on the substrate 56. In this instance, the color shift would be seen through the substrate 56 and would by necessity be optically transparent.

By way of example, optically variable devices incorporating the present invention with release layers therein have been provided in which color shifts have been achieved. One optically variable device had a green color in reflectance when viewed at normal incidence and at a viewing angle of approximately 45°, it had a blue color. After it was pulled apart all that could be seen on one side was an aluminum reflector and on the other side a greyish color in transmission and at an angle only a tinge of blue in reflection. Thus the optically variable device after it once had been separated by the use of the release layer and then placed together again would have a silvery color at all angles, i.e., no color change with angle, which would clearly indicate that the optically variable device had been separated. In other words, the optically variable device had its color shift capabilities destroyed clearly indicating tampering with the optically variable device.

The optically variable device 26 can be any one of the optically variable devices 51, 52 and 53 described in FIGS. 4, 5 and 6. As shown in FIG. 3, the optically variable device can be incorporated between the two flaps 19 and 21 of the cardboard carton or container 11. Suitable means is provided for securing the optically variable device to the flaps 19 and 21 and as shown in FIG. 3 can take the form of layers 66 and 67 of a suitable adhesive. The layer 66 secures the flap 21 to the substrate 42 and the adhesive layer 67 secures the flap 19 to the layer 37. After the optically variable device has been glued between the two flaps 19 and 21 by the use of the adhesive layers 66 and 67 and is positioned in such a manner so that it is visible through the opening 27, a color shift with angle can be ascertained. By way of example, at normal incidence, the optically variable device will have a green appearance and at an angle of approximately 45°, the optically variable device will have the color of blue.

When the outside flap 21 is opened, the optically variable device 26 will be separated at the release layer 39. As soon as the optically variable device has been separated, the angle shifting properties are destroyed. Thus it can be seen that if such an optically variable device were to be utilized on a package for a consumer type product, the consumer picking up the product from a store shelf could readily ascertain whether or not there has been any tampering with the product by viewing the optically variable device to ascertain whether or not a color shift occurs with change of viewing angle. If there is no color shift, then the consumer knows that the product has been tampered with and should not be purchased.

In the embodiment shown in FIG. 3 it can be seen that the reflector can be deposited on the substrate followed by the spacer layer and the absorber layer. In certain applications, it may be desirable to reverse this sequence by depositing the absorber layer on the substrate followed by the spacer layer and then depositing the reflector layer. When manufactured in this manner, the optically variable device can be mounted in the manner shown in FIG. 3 in which the substrate 42 faces the opening making it necessary to view the optically variable device through the polyester film which is utilized for the substrate. Such an arrangement is desirable because the polyester film inhibits cutting through the optically variable device and removing a portion of the optically variable device. Such cutting operation can be inhibited by the use of serrations 32 as shown in FIG. 2. By providing such serrations, it would be very difficult, if not impossible, to remove a portion of the optically variable device and affix it to another carton already tampered with without destroying the same. It should be appreciated that if desired, the optically variable device can be positioned in such a manner so that the substrate is positioned away from the opening 27.

Figure 9:
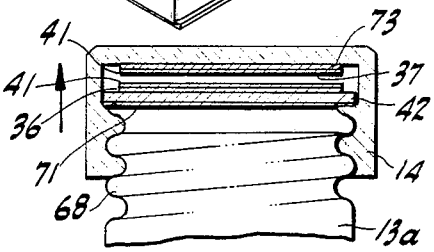
FIG. 9 is a cross-sectional view showing the manner in which the optically variable device incorporating the present invention can be destroyed.
Figure 8:
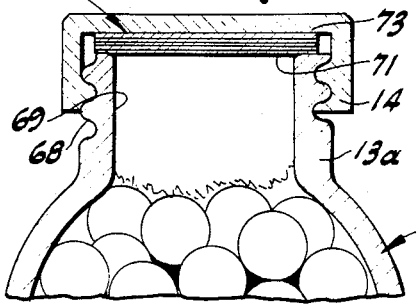
FIG. 8 is a cross-sectional view similar to FIG. 7 but showing a transparent cap mounted on the container.

Another embodiment of the invention is shown in which the tamper evident optically variable device is incorporated into the bottle itself rather than into the package containing the bottle. This embodiment is shown in FIGS. 7, 8 and 9. As shown therein, the bottle 13 is provided with a necked portion **13*a* which is provided with external threads 68 which are adapted to receive the cap 14 which encloses the opening 69 in the neck 13*a*. An optically variable device 26 of the type hereinbefore described is sized to fit over the top of the necked portion 13*a* and has one side of the same, as for example, the substrate side secured to the top of the necked portion 13*a* by suitable means such as an adhesive layer 71. After the optically variable device 26 has been applied to the top of the bottle 13, a clear adhesive 72 is applied to the top of the optically variable device 26 as shown in FIG. 7 and thereafter the cap 14 is screwed onto the necked portion 13*a* of the bottle 13 to spread out the glue 72 to form an adhesive layer 73 between the cap and the optically variable device 26. The cap 14 as shown is transparent so that the optically variable device 26 can be viewed through the adhesive and top of the cap. It should be appreciated, if desired, a portion of the cap can be formed so it is opaque with only a portion of the same being transparent so as to permit viewing of the optically variable device 26**.

When the bottle 13 is opened by rotating the cap 14, the optically variable device 26 is destroyed because the adhesive layers 71 and 73 hold the optical device 26 to the top of the neck of the bottle **13*a* and the bottom inside of the cap 14 so that rotation of the cap 14 causes a shearing action to take place within the optically variable device 26 along the plane of the release layer provided within the spacer layer 41 to cause the optically variable device to separate as shown in FIG. 9** and to cause destruction of the angle shifting characteristics of the optically variable device. Thus again it can be seen that if the bottle has been tampered with, the optically variable device will be destroyed which will give a visible indication to the consumer that tampering has occured because the angle shift properties causing the changes in color with viewing angle will no longer be present.

Figure 10:
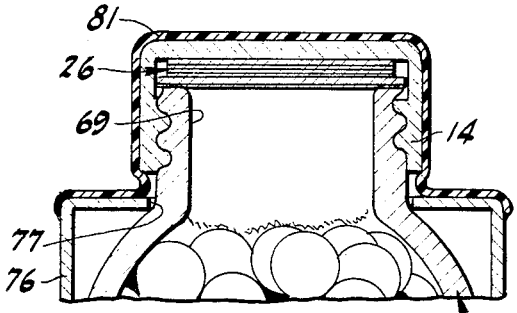
FIG. 10 is a partial cross-sectional view of a container utilizing a tamper evident optically variable device and also utilizing a shrink wrap fitting.

Another embodiment of consumer type packaging is shown in FIG. 10 and consists of a rectangular cardboard container or package 76 which can be rectangular in cross section and which is provided with an opening 77 in its top side through which the necked portion **13*a* of the bottle 13 can extend. The bottle is provided with a transparent cap 14 of the type hereinbefore described through which the optically variable device 26 positioned therein can be viewed. A shrink wrap 81 of a conventional type also formed of a transparent plastic can be applied to the top of the bottle and to the to top of the container 76 to facilitate handling of the package. In such an embodiment it is still possible to view the optically variable 26 through the transparent wrap 81 and also through the transparent cover 14 to see whether or not tampering has occurred with respect to the bottle 13 by viewing the optically variable device 26** to see whether the angle shift properties are present.

From the foregoing it can be seen that there has been provided a tamper evident optically variable device which can be utilized in connection with various types of articles such as containers for packaging various products and particularly consumer type products. The optically variable device can also be used on customs seals, classified document seals and the like. The tamper evident optically variable device can be readily incorporated into conventional type packaging utilized on consumer products. The tamper evident optically variable device has such characteristics that the public can be readily educated to ascertain whether or not tampering has occurred with respect to the container or package carrying the product. The consumer at the point of sale can readily ascertain whether tampering has occurred by viewing the optically variable device. If the optically variable device is without color shift properties when viewed at different angles, the consumer will know that tampering has occurred and can bring this to the attention of the retailer distributing the product.

What is claimed is:

1. In a tamper evident optically variable device, at least first and second layers with a spacer layer therebetween providing an optical color shift with change in viewing angle, and a release layer disposed between the first and second layers and forming a part of the optically variable device, said release layer permitting the first and second layers to be separated from each other to destroy the optical color shifting properties of the optically variable device.

2. A device as in claim 1 wherein the release layer is relatively thin so that it does not effect to a significant degree the optical properties of the optically variable device.

3. A device as in claim 2 wherein the release layer is formed of a material which has an index of refraction which is near that to the index of refraction of the material forming the spacer layer.

4. A device as in claim 1 wherein the first layer is a reflective layer and the second layer is an absorber layer, said reflective layer and said absorber layer being formed of metal and said spacer layer being formed of a dielectric.

5. A device as in claim 4 wherein the release layer is disposed in the spacer layer.

6. A device as in claim 4 wherein the release layer is disposed between the spacer layer and the absorber layer.

7. A device as in claim 4 wherein the release layer is disposed between the spacer layer and the reflective layer.

8. A device as in claim 1 wherein the first and second layers in the spacer layer are carried by a substrate.

9. A device as in claim 8 wherein the substrate is formed of a transparent material.

10. A device as in claim 9 wherein said substrate is formed of a transparent plastic.

11. In a tamper evident article, the article having first and second parts which are movable with respect to each other, and a tamper evident optically variable device disposed between and secured to the first and second parts and exhibiting a color shift with change in viewing angle, the tamper evident optically variable device having first and second layers with a spacer layer and a release layer disposed between the first and second layers, the release layer forming a part of the optically variable device and permitting separation of the optically variable device into two separate parts to destroy the optically variable color characteristics of the optically variable device when the first and second parts are moved with respect to each other.

12. An article as in claim 11 wherein the article is a container having first and second flaps which are adapted to overlie each other and serve as said first and second parts.

13. An article as in claim 12 wherein a portion of at least one of the first and second parts has a portion thereof which is formed in such a manner so as to permit viewing of the optically variable device from the exterior of the container.

14. An article as in claim 13 wherein one of the first and second parts has an opening formed therein through which the optically variable device can be viewed.

15. An article as in claim 14 wherein the optically variable device includes a transparent substrate and wherein the optically variable device is positioned between the first and second parts so that the substrate of the optically variable part faces the opening.

16. An article as in claim 14 wherein the opening is formed by providing serrations in one of the first or second parts to deter cutting and removal of the optically variable device through the opening.

17. An article as in claim 11 wherein said article is a bottle having a neck portion with an opening extending therethrough and having a cap removably secured to the neck portion and closing said opening and wherein the neck portion of the bottle and the removable cap serve as said first and second parts.

18. An article as in claim 17 wherein the optically variable device is disposed between the top of the neck portion of the bottle and the interior of the cap.

19. An article as in claim 18 wherein the cap has at least a transparent portion to permit viewing of the optically variable device through the cap.

20. An article as in claim 11 wherein the optically variable device is provided with a release layer to permit separation of the optically variable device in the event the first and second parts are removed with respect to each other after the optically variable device has been positioned in the package.

21. An article as in claim 20 wherein the optically variable device is provided with at least three layers formed of a metal, a dielectric and a metal.

* * * * *